US005683287A

United States Patent [19]

Martineau et al.

[11] Patent Number: 5,683,287

[45] Date of Patent: Nov. 4, 1997

[54] PROCESS AND DEVICE FOR DEBURRING AND CHAMFERING EDGES OF OPENINGS EXTENDING THROUGH A PLATE MAINTAINING A BUNDLE OF TUBES

[75] Inventors: Francois Martineau, Chalon-sur-Saone; Nõel Martin, St Remy, both of France

[73] Assignee: Framatome, Courbevoie, France

[21] Appl. No.: 407,675

[22] Filed: Mar. 21, 1995

[30] Foreign Application Priority Data

Mar. 22, 1994 [FR] France ..... 94 03357

[51] Int. Cl.[6] ..... B24B 49/00; B24B 57/00

[52] U.S. Cl. ..... 451/1; 451/5; 451/11; 451/51; 451/61; 451/59

[58] Field of Search ..... 451/1, 5, 11, 43, 451/51, 61, 57, 59

[56] References Cited

FOREIGN PATENT DOCUMENTS 032 102 7/1981 European Pat. Off. .
137 859 9/1983 European Pat. Off. .

OTHER PUBLICATIONS

"Entgraten mit Industrierobotern", Dipl–Ing. L. Schramm, Furth/Bayern, Sep. 1990, No. 9, Munich.

*Primary Examiner*—Robert A. Rose
*Assistant Examiner*—George Nguyen
*Attorney, Agent, or Firm*—Pollock, Vande Sande & Priddy

[57] ABSTRACT

At least one brush rotatable about an axis parallel to the plate (1) and to a plane containing a row of bearing surfaces (4) of openings (2) of the plate (1), is moved along a rectilinear path (*5a, 5b, 5c*) parallel to the plane of the bearing surfaces (4) of the openings (2) of the row of the plate (1). Preferably, the device comprises a brushing unit mounted at the end of an articulated arm of a robot permitting the movement of the brushing unit in succession along rectilinear paths (*5a, 5b, 5c*) constituting several groups in which the paths are parallel to the same direction.

8 Claims, 5 Drawing Sheets

PROCESS AND DEVICE FOR DEBURRING AND CHAMFERING EDGES OF OPENINGS EXTENDING THROUGH A PLATE MAINTAINING A BUNDLE OF TUBES

FIELD OF THE INVENTION

The invention relates to a process and a device for deburring and chamfering edges of openings extending through a plate maintaining a bundle of tubes.

BACKGROUND OF THE INVENTION

In the manufacture of heat exchangers, in particular of steam generators of pressurized water nuclear power stations, large apertured plates are provided for fixing and supporting the tube bundle of the heat exchanger.

Steam generators of pressurized water nuclear reactors comprise a large case of generally cylindrical shape in which there is disposed a bundle of tubes of small diameter fixed in a sealed manner in a tube plate at each of their ends. These tubes extend vertically to a great length toward the interior of the case of the steam generator and are bent with a certain curvature in their upper part.

The primary water travels through the tubes of the bundle and the secondary water is introduced into the case of the steam generator and is heated and vaporized upon contact with the outer surface of the tubes. The steam is thereafter recovered by the secondary circuit of the reactor.

The vertical parts of the tubes of the bundle must be maintained in position relative to one another so that the cross sections of the tubes constitute regular networks in planes perpendicular to the axis of the exchanger.

For the purpose of maintaining the tubes in position, spacer plates are employed which are spaced apart at a given spacing along the height of the heat exchanger. These spacer plates are apertured in such manner as to comprise a network of through apertures for receiving the tubes of the bundle, so that these tubes are disposed in a regular network in the cross sections of the exchanger.

To permit circulation of the secondary fluid in the vertical direction and to avoid deposits of corrosive material in the zones of contact between the tubes and the spacer plates, it is necessary to provide openings of more or less complex shapes in the spacer plates to ensure geometrical positioning and effective mechanical maintenance of the tubes, and the circulation of the secondary fluid, and to prevent the accumulation of impurities which may be found in this fluid. The through openings of the spacer plates each comprise at least three bearing surfaces for a respective tube of the bundle, and these are arranged around the opening in such manner as to maintain the tube in all transverse directions, and radial peripheral recesses allowing the passage of the cooling fluid around the tube received in the opening.

The openings may, for example, comprise three bearing surfaces and three radial extensions between the bearing surfaces spaced 120° apart around the axis of the opening on which the tube is engaged. The openings are then termed trifoliate openings.

The openings may also comprise four bearing surfaces and four radial extensions between the bearing surfaces spaced 90° apart around the axis of the opening on which the tube is engaged.

The openings are then termed quadrifoliate openings.

These openings of more or less complex shape extending throughout the thickness of the spacer plates are produced by machining operations such as drilling, boring, and possibly broaching. The broaching is carried out after the drilling of the plate which provides a network of initial openings.

The openings produced by mechanical machining usually have, in the region of the faces of the plate, sharp corners or burrs formed by metal which was pushed back by the machining operation, so that the edges of these openings must be deburred and/or chamfered on the faces of the spacer plate.

Indeed, the tubes of the bundle which are forced into the openings in the axial direction have a surface state of very high quality and must not undergo any damage or scratching when mounting the bundle. The scratches on the outer surface of the tubes may give rise to cracking and fracture of the tubes when the steam generator is in service.

Therefore, before inserting the tubes and mounting the bundle, a finishing machining operation must be carried out on the edges of the through openings of the spacer plates to eliminate the burrs and round off the sharp corners of these edges.

In the case of a network of openings formed by broaching, the face of the spacer plate through which the broach enters has sharp corners, and the face of the spacer plate through which the broach leaves the plate has burrs on the edges of the openings.

In applicant's FR-A-2,472,961, filed on Jan. 4, 1980 by the firm, there is proposed a device for deburring and chamfering the openings of an apertured plate. The device comprises a brush mounted on a carriage to rotate about an axis of symmetry arranged parallel to the plate and movable in a direction perpendicular to the plate. The carriage is mounted on a support movable in a first direction parallel to the plate so as to be movable in a second direction parallel to the plate.

In this way the entire surface of the plate can be swept over or scanned by the brush driven in rotation about its axis.

The brush, comprising bristles of steel or synthetic fibers which may be associated with an abrasive, effects a deburring and/or a chamfering of the edges of the openings with which the fibers come into rubbing contact during the movement of the brush in a direction parallel to a face of the plate with a certain penetration of the bristles in a direction perpendicular to the plate.

However, examination of the edges of the openings after a deburring or chamfering operation shows that the chamfers produced by the brush do not have a regular and constant shape throughout these edges. Further, the brushing is liable to push back the metal of the edge of the openings of the plate or of the burrs of metal, so that the edges of the openings of the plate have portions which project from the planar surface of the plate onto which the openings open.

It is desirable for the chamfers of the edges of the openings to have, in a section through a plane containing the axis of the opening, a continuous rounded shape between the face of the plate and the inner surface of the opening with no portion which projects from the face of the plate or from the inner surface of the opening.

If the edges of the openings of the plate are not correctly chamfered or have residual burrs in the region of the bearing surfaces for the tubes of the bundle, the tubes of the bundle may be damaged, for example by a scratching of their surface, when they are inserted into the openings of the spacer plate.

The bearing surfaces for the tubes of the bundle disposed on the periphery of the openings of the spacer plates have a substantially planar shape. Owing to the arrangement of the through openings in the spacer plate in a regular network, the openings constitute rectilinear rows in which the axes of the aligned openings are disposed in a plane perpendicular to the faces of the plate.

The centers of the bearing surfaces of the openings constituting a row are disposed and aligned in planes parallel to the planes containing the axes of the aligned openings.

In the case of openings of trifoliate shape arranged in a network having triangular meshes, the bearing surfaces for the tubes, inside the openings, are disposed in three families of planes of which the traces on the faces of the plate make angles of 120° with one another.

In the case of openings of quadrifoliate shape arranged in a network having square meshes, the bearing surfaces for the tubes inside the openings are disposed in two groups of planes parallel to one another and extending at 90° to one another.

No process is known from the prior art for deburring and chamfering which permits obtaining chamfers of regular shape without portions of metal which have been pushed beyond the faces of the plate, throughout the bearing surfaces for the tubes inside the openings.

SUMMARY OF THE INVENTION

An object of the invention is therefore to provide a process for deburring and chamfering edges of openings extending through a plate for maintaining a bundle of tubes arranged in a regular network and each comprising at least three bearing surfaces for a tube of the bundle, the bearing surfaces of all of the openings of the plate being contained in planes perpendicular to the faces of the plate and parallel to the axes of the openings. In each of the planes is disposed in an aligned manner in a rectilinear direction a group of bearing surfaces of a rectilinear row of openings of the network. The process comprises moving at least one brush which is rotatable about an axis parallel to the plate so as to cause it to sweep across at least one face of the plate and produce opening edges devoid of burrs and having chamfers of regular shape without a portion of metal which has been pushed beyond the planes of the faces of the plate.

To this end, the process comprises deburring and chamfering the edges of the openings in successive rectilinear rows and, for each of the rectilinear rows, moving the brush with its axis of rotation parallel to a plane containing a row of bearing surfaces, in a rectilinear path parallel to the plane of the row of bearing surfaces.

There will now be described, with reference to the accompanying drawings and by way of example, an embodiment of a deburring and chamfering device according to the invention employed for deburring and planing a spacer plate of a steam generator of a pressurized water nuclear reactor.

DETAILED DESCRIPTION

Figure 1:
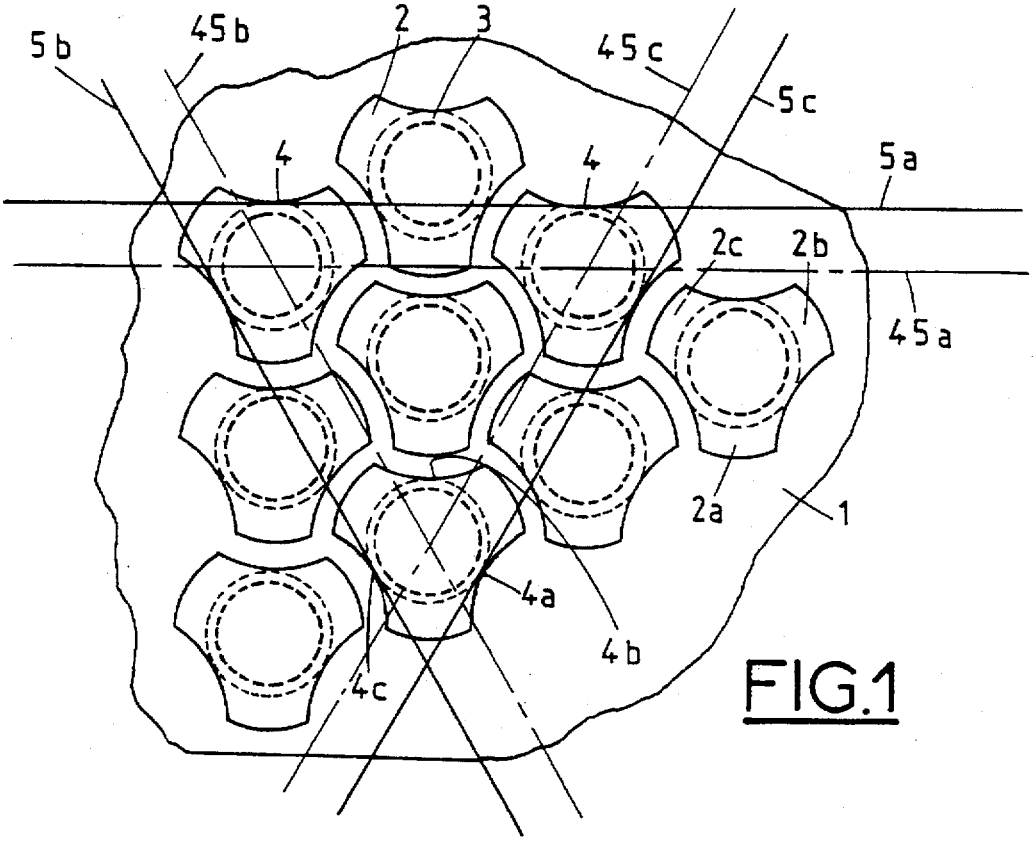
FIG. 1 is a plan view of a part of a spacer plate comprising openings of trifoliate shape.

Shown in FIG. 1 is a part of a spacer plate 1 of a steam generator of a pressurized water nuclear reactor adapted to maintain the tubes of a tube bundle of the steam generator in a regular network in a transverse plane of the bundle.

The plate 1 consists of an entirely planar steel plate of circular shape having a diameter on the order of four meters.

Extending through the plate 1 are several thousand openings 2 arranged in a regular network for maintaining the tubes 3 of the network in a regular arrangement. In the case of the plate shown in FIG. 1, the centers of the circular sections of the tubes 3 constituting the intersections of the axes of the tubes with the plane of the figure, constitute a network having triangular meshes. The openings 2 allowing the passage and the maintenance of the tubes have, in this embodiment, a trifoliate or trilobate shape, each of the openings 2 having three extensions 2*a*, 2*b*, 2*c* extending radially from the tube 3 in directions spaced 120° apart from one another around the axis of the tube.

Between any two successive radial extensions of an opening 2, the wall of the opening comprises a portion 4 of substantially planar or cylindrical shape coaxial with the opening 2 and extending in the direction of the thickness of the plate 1, i.e., in the axial direction of the tubes 3.

The three planar surfaces 4*a*, 4*b*, 4*c* of the wall of an opening 2 which are spaced 120° apart from one another around the axis of a tube 3 constitute bearing or support surfaces for the tube 3 whereby it is maintained inside the opening 2 in a perfectly centered position, i.e., in such manner that the axis of the tube 3 and the axis of the opening 2 are coincident.

In this manner, when the tube 3 is in position in the opening 2, the three radial extensions 2*a*, 2*b*, 2*c* of the opening 2 constitute through passages in the plate 1 around the tube 3. These through passages allow the circulation of the feed water of the steam generator which comes in contact with the outer surface of the tubes 3 in the course of its circulation in the vertical upward direction inside the casing of the steam generator.

The primary water at elevated temperature coming from the vessel of the nuclear reactor and the feed water circulate outside the tubes and in contact with the outer surface of the latter. The feed water is in this way heated and then vaporized by heat exchange with the primary water through the wall of the tubes 3.

The bearing surfaces 4 for the tubes 3 in the openings 2 are located in planes perpendicular to the planar faces of the plate 1 and aligned within these planes in rectilinear directions which may be represented in FIG. 1 by traces of the planes containing the bearing surfaces 4 of the tubes on the faces of the plate 1.

In the embodiment shown in FIG. 1 (triangular network having trilobate openings), there are three directions 5*a*, 5*b* and 5*c* which form angles of 60° with one another and correspond to the directions of alignment of the bearing surfaces 4 for the tubes of the openings 2. The planes in which these bearing surfaces 4 are disposed constitute three parallel families of planes the traces of which are all parallel to one another and parallel respectively to the directions 5*a*, 5*b* and 5*c* which form angles of 60° with one another.

The planes of the traces 5*a*, 5*b*, 5*c* are parallel to planes in which are disposed the axes of a group of openings 2 which are aligned parallel to 5*a*, 5*b* or 5*c*. However, the directions 5*a*, 5*b*, 5*c* of the aligned bearing surfaces do not correspond to the principal directions of the rows of openings 2 or tubes 3.

Figure 2:
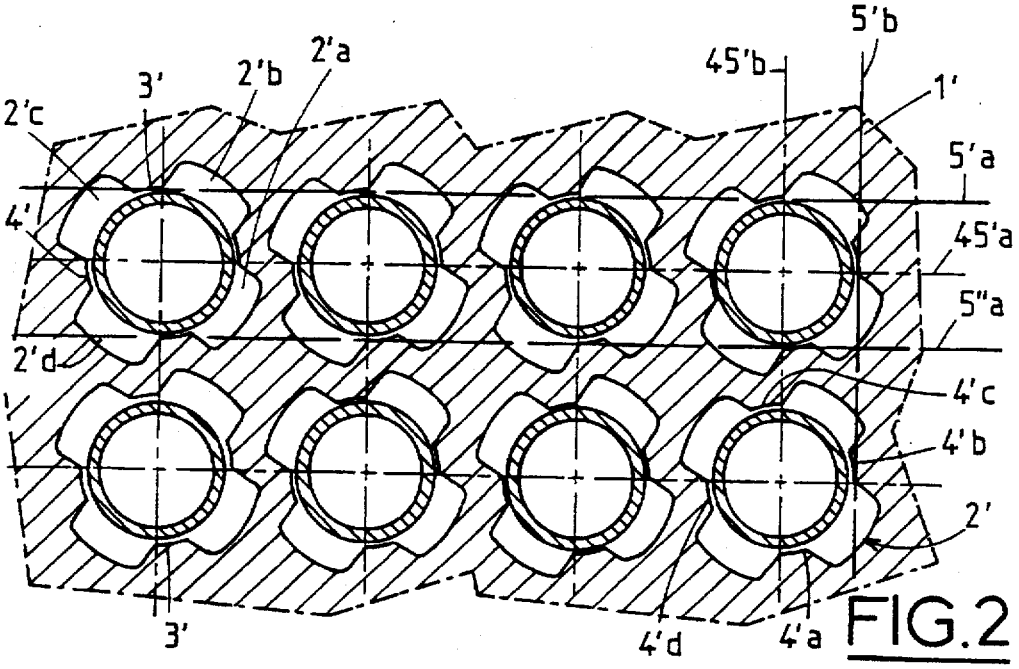
FIG. 2 is a plan view of a part of a spacer plate comprising openings of quadrifoliate shape.

A second embodiment of a spacer plate 1' for maintaining tubes 3' of a bundle of tubes of a steam generator of a pressurized water nuclear reactor is shown in FIG. 2.

The openings 2' extending through the plate 1' are arranged in a network having square meshes and are produced in a quadrifoliate or quadrilobate shape, each of the openings 2' comprising four extensions 2'*a*, 2'*b*, 2'*c*, 2'*d* extending in radial directions spaced 90° apart from one another around the axis of the tube 3'.

The radial extensions 2'*a*, 2'*b*, 2'*c*, 2'*d* of the openings 2' on the periphery of the tubes 3' allow the passage of the feed water through the spacer plate 1' in the steam generator in service.

Between any two radial extensions 2'*a*, 2'*b*, 2'*c*, 2'*d*, the surface of the opening 2' includes a planar bearing surface 4'. Each of the openings 2' comprises four substantially planar bearing surfaces 4'*a*, 4'*b*, 4'*c*, 4'*d* spaced 90° apart from one another around the axis of the opening 2' and extending through the thickness of the plate 1', i.e. parallel to the axis of the openings 2' and of the tubes 3'. The bearing surfaces 4' maintain the tubes 3' in a perfectly centered position in the openings 2'.

The bearing surfaces 4' are contained in two families of planes which are parallel to one another and have direction traces 5'*a* and 5'*b* on the faces of the plate 1'. The directions 5'*a* and 5'*b* correspond substantially to the principal directions of the rectilinear rows of openings 2' of the network of the plate 1'.

After having machined the through openings such as 2 or 2' of a spacer plate such as 1 or 1', it is necessary, before inserting the tubes 3 or 3' of the bundle in the openings 2 or 2', to eliminate burrs formed by the broaching on one of the faces of the plate and the sharp corners formed on the other face of the plate on the edge of the openings 2 or 2'. The operation for deburring one of the faces of the plate and planing the other face must result in regular rounded chamfers around the openings 2 and 2' on each of the faces of the plate and in particular in the parts of the edges of the openings 2 and 2' corresponding to the planar bearing surfaces 4 and 4'.

It is desirable to form a regular chamfer throughout the edges of the openings, so that the chamfered opening edge has no portion which projects from the faces of the plate and from the interior of the opening. In this way, the spacer plate remains perfectly planar and the tubes are not scratched when they are inserted in the through openings of the spacer plates to make up the bundle.

In the case of a deburring and chamfering achieved by a complete sweeping or scanning of the faces of the plate with a rotary brush, there were found irregular chamfer shapes and raised beads of metal projecting from the faces of the plates when the brushing is carried out without control of the directions of motion of the brush on the faces of the spacer plate.

Such defects were found the case of plates in on which the chamfering was carried out with the use of a shifting device comprising a carriage having crossed motions for moving a rotary brush across the faces of the spacer plates in any manner relative to the rows of openings.

Figure 3:
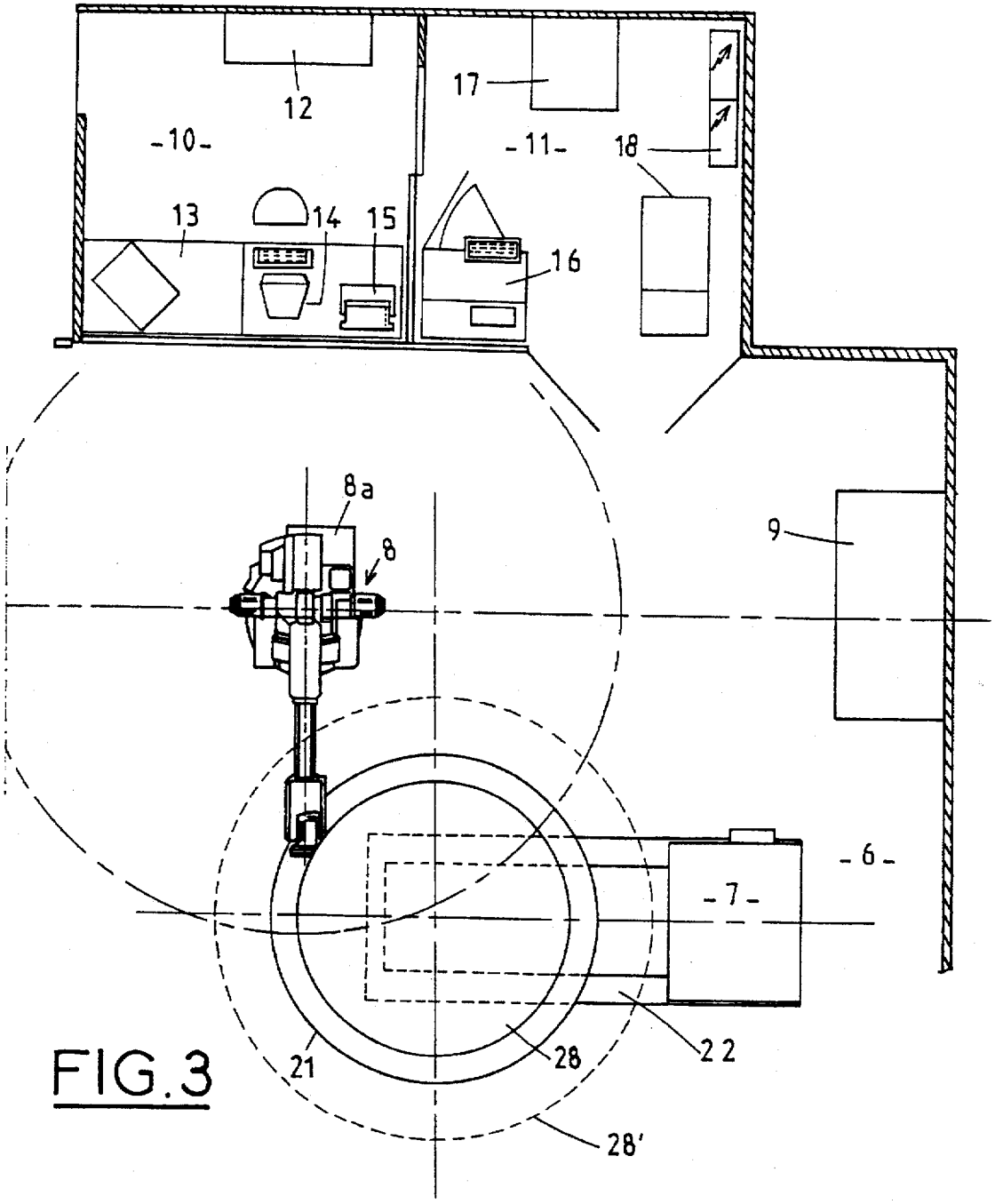
FIG. 3 is a general plan view of a deburring and chamfering station for carrying out the process according to the invention.
Figure 4:
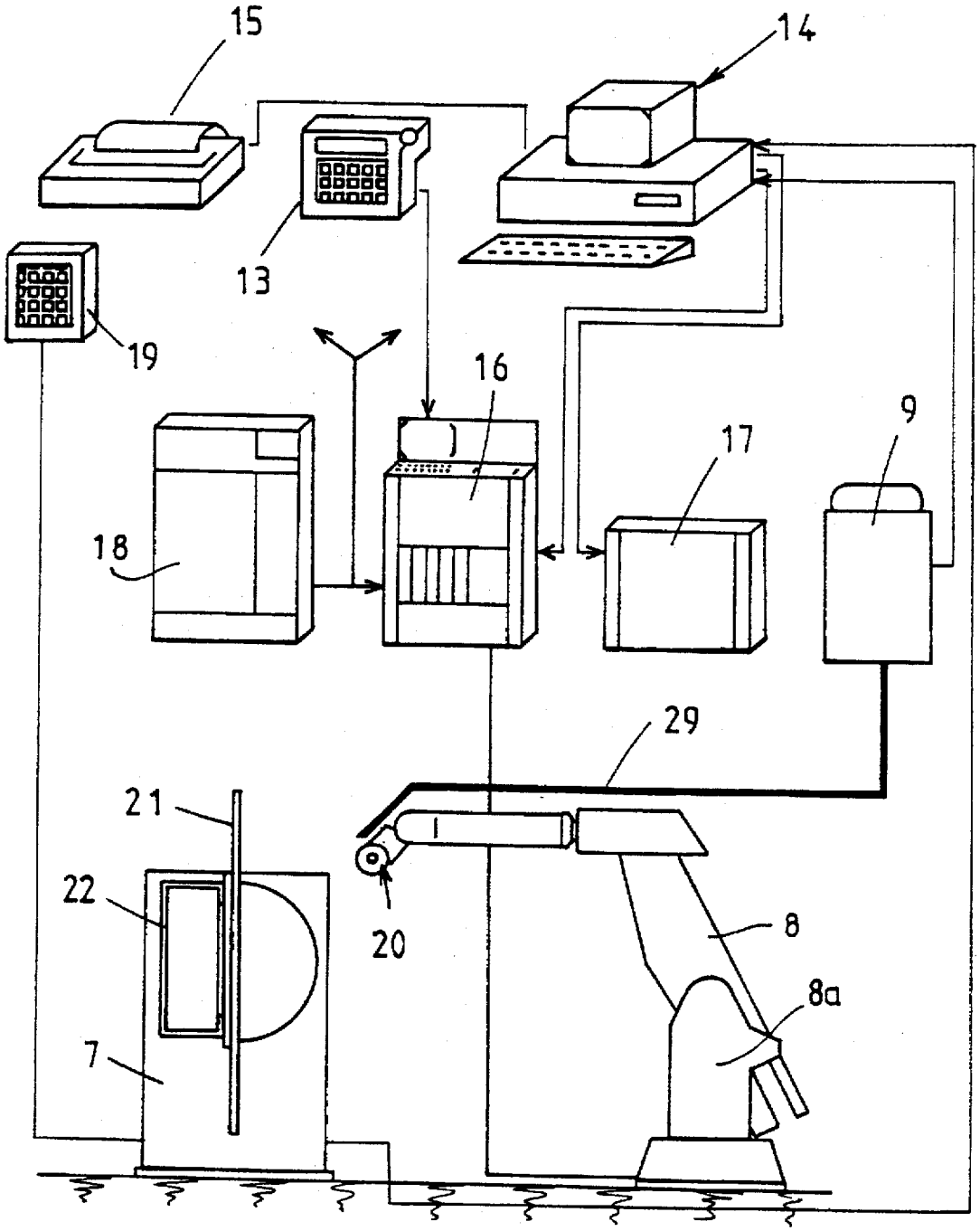
FIG. 4 is a schematic elevational view of the deburring and chamfering station shown in FIG. 3.

FIGS. 3 and 4 show an installation for carrying out the process according to the invention in which the brushing of the faces of the plate is carried out in well-defined directions and conditions.

The installation comprises, in a workshop 6, a device for positioning spacer plates 7, a robot 8 for moving a brushing unit and a suction device 9.

The installation further comprises a control station 10 and technical premises 11 adjacent to the workshop 6. Disposed in the control station 10 are a control cabinet 12, a control console 13 for the positioning device 7 and the robot 8, a microcomputer 14 and a printer 15.

Disposed in the technical premises 11 are a control cabinet 16 for the robot 8, a control cabinet 17 for the brushing unit, and electric power supply units 18.

Disposed on the control console 13 is a box 19 having control buttons for the remote control of the positioning device 7 positioning the spacer plate.

The robot 8 may be employed for remote control machining or welding operations with motions in a variety of paths in space.

This robot comprises an articulated arm which has six axes of articulation and is mounted on the floor of the workshop by a support stand 8*a*.

For carrying out the process according to the invention, the brushing unit 20, described in more detail hereinafter, is mounted on the end part of the arm termed wrist.

The device 7 for positioning the spacer plate comprises a platform 21 in the form of a planar plate carried by an arm 22.

The platform 21 is provided with tapped holes in given positions in which may be screwed spacer plate positioning and clamping members when the spacer plate is superimposed on the platform 21.

The positioning members are engaged and screwed in the platform 21, and the spacer plate on which the deburring and chamfering operation is to be carried out is placed in position on the platform by engaging the positioning members in openings of the spacer plate provided for the passage of tie rods which fix the spacer plates to one another in the steam generator.

The spacer plate is then fixed on the platform by engaging the clamping members in the openings for the passage of the tie members of the spacer plate and screwing these clamping members in the tapped holes in the platform 21.

Figure 5:
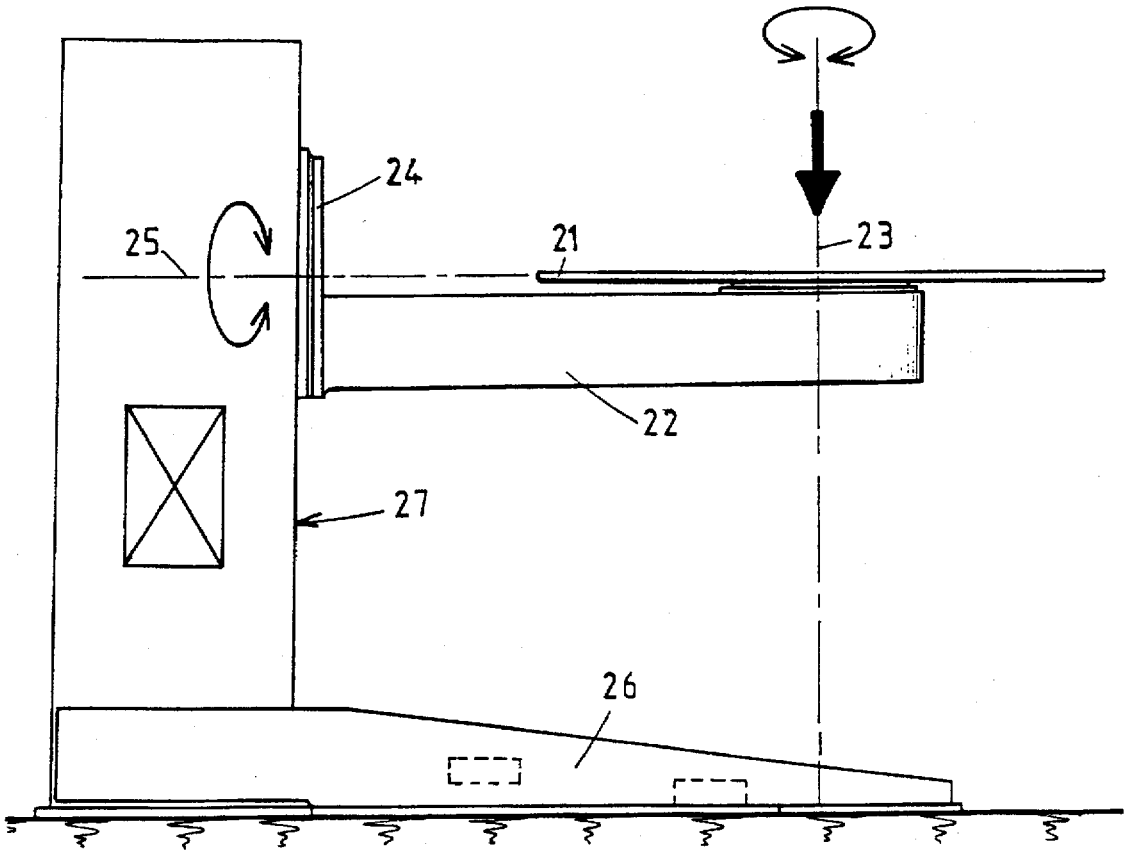
FIG. 5 is an elevational view of a device for positioning the spacer plate.

As can be seen in FIG. 5, the platform 21 is mounted for rotation about an axis 23 on the arm 22 of the positioning device, the arm 22 being itself fixed to a platform 24 mounted for rotation about an axis 25 on the vertical frame of the positioning device 7, which includes shoes which bear against and are fixed to the floor 26.

The rotation of the platform 24 about the axis 25 permits driving the arm 22 in rotation about the axis 25 and orienting the platform 21.

Driving, guiding and indexing of platform 24 are arranged to place the platform 21 in at least one of three positions which respectively correspond the horizontal position of the platform 21 shown in FIG. 5, a vertical position of the platform and a position inclined at 30° to the vertical.

A spacer plate may be mounted on the platform 21 when the latter is in its vertical position. The spacer plate is brought in proximity to the platform 21 in a vertical position suspended from the sling of hoisting means of the workshop 6. The spacer plate is engaged on the positioning members fixed to the platform 21 and then clamped to the platform 21 by the clamping members. Usually, two positioning members and four clamping members are used for clamping a spacer plate to the platform 21 of the spacer plate positioning device 7.

As can be seen in FIG. 3, it is possible to place on the platform 21 of the positioning device 7 a spacer plate having diameter of between given minimum and a maximum values. In FIG. 3, the plate 28 shown in solid lines has a minimum diameter and the plate 28' shown in dotted lines has a maximum diameter, depending on the machining possibilities inside the workshop 6.

For example, in the case of spacer plates for steam generators of pressurized water nuclear reactors, a positioning device and a robot are provided which permit the finishing machining of plates having a diameter of between 2.40 and 4 meters.

The plates have been shown in a horizontal position in FIG. 3.

The finishing machining for deburring and chamfering the plates by brushing is carried out with the spacer plate inclined rearwardly at 30° to the vertical so that the face of the plate to be machined is facing toward the robot 8 and toward the control station 10 adjacent to the workshop 6.

It will be clear that the finishing machining of both faces of the plate can be carried out by turning the spacer plate over on the platform 21 after machining of the first face.

A suction pipe 29 connected at one of its ends to the suction device 9 is disposed above the arm of the robot 8 in such manner as to place the second end in a position to open onto the brushing unit 20 at the end of the arm of the robot 8. The dust and the filings produced by the brushing of a spacer plate can be in this way drawn off, which prevents the dust from being blown about and the filings from dropping onto the floor of the finishing workshop 6.

Figure 6:
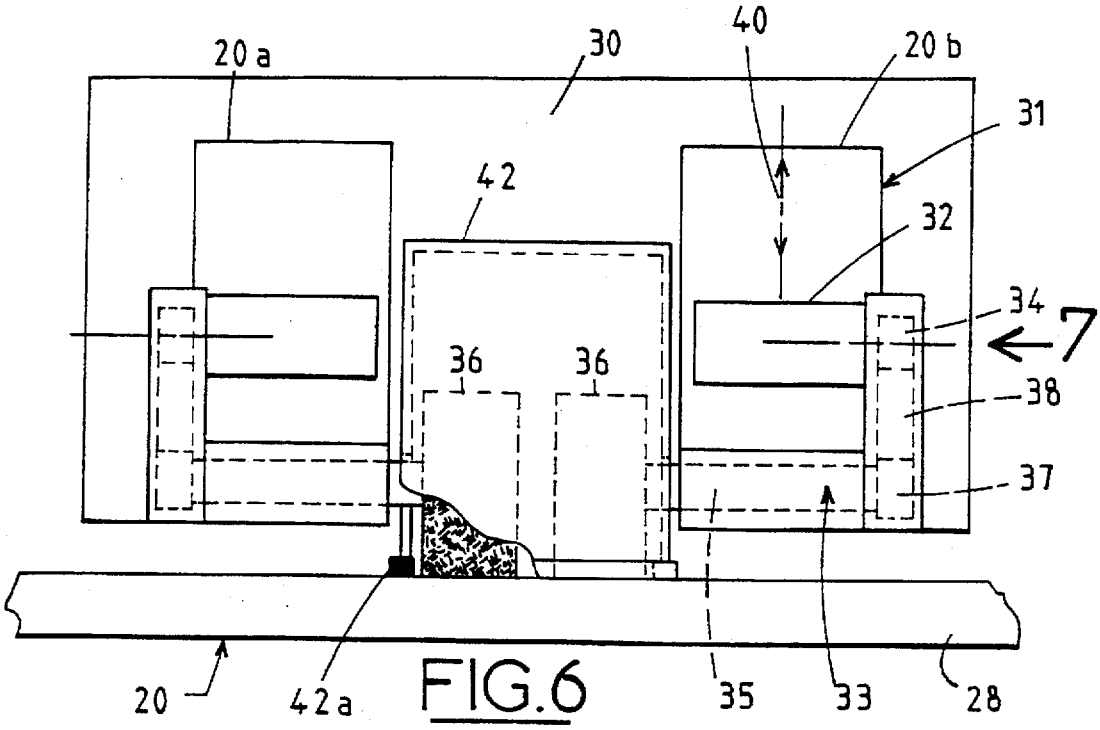
FIG. 6 is an elevational view in the direction of arrow 6 of FIG. 7 of a brushing unit of a deburring and chamfering device of a plant such as that shown in FIGS. 3 and 4.
Figure 7:
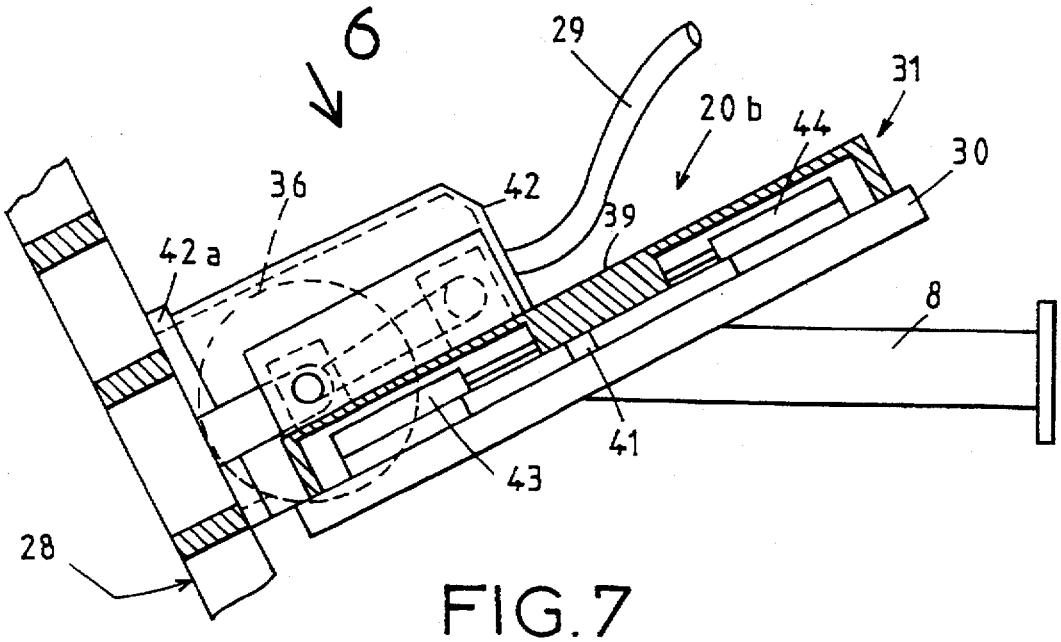
FIG. 7 is a side elevational view in the direction of arrow 7 of FIG. 6 of the brushing unit in the active position.

As can be seen in FIGS. 6 and 7, the brushing unit 20 compromises two brushing devices **20*a* and 20*b* carried by a support member 30 which is fixed to the end of the arm of the robot 8** constituting the wrist of the arm.

Each of the brushing devices, such as **20*a* and 20*b*, comprises a device 31 mounted on the support member 30 for moving the brush and applying pressure, a motor unit 32 and a brushing tool 33 which is driven in rotation by the motor unit 32**.

The motor unit 32 comprises an output sprocket 34 and the brushing tool 33 comprises a shaft 35 fixed at one of its ends to a cylindrical brush 36 and at its other end to a sprocket 37. A toothed driving belt 38 operatively connects the output sprocket 34 of the motor unit 32 to the sprocket 37 of the brushing tool 33.

Each of the motor units 32 and the associated brushing tool 33 are mounted on a slide 39 of the shifting and pressure applying device 31. The slide 39 is mounted to be movable in the direction of the axis 40 on the support member 30.

Cylinder devices 43 and 44 mounted on the support member 30 permit moving the slide 39 in the direction of the axis 40, so as to put the brushes 36 of the brushing tools 33 in operative position in contact with a face of a spacer plate. The cylinder devices also permit exerting a given force on the brushing tools 33 so that the brushes 36 are applied against the face of the plate 28 in the course of machining with a given pressure for machining the edges of the openings of the spacer plate.

The cylinder device 43 is a balancing cylinder device for eliminating the resultant of the weight of the brushing device projected onto a plane positioned at an angle of 30° to the horizontal. The cylinder device 44 is a thrust exerting device for applying the bearing force on the brush 36.

The support member 30 also carries a linear position sensor 41 for sensing with precision the position of the slide 39 on the support member 30. The sensor 41 constitutes a sensor sensing the wear of the brush, the indications of which permit recalculating the position of the robot for each path so as to always operate with the slide 39 within its travel designed as a function of the wear and irrespective of the wear of the brush 36, and to signal the necessity to change the brush 36 after a certain amount of wear.

The motor unit 32, the sprockets 34 and 37, the belt 38 and the shaft 35 of each of the brushing devices are disposed within a protective housing.

A suction case 42 having a substantially parallelepipedic shape is also disposed around the brushes 36. The case 42 has an open side in its lower part enabling the brushes 36 to act on the face of the spacer plate in the course of machining.

The case 42 includes a sealing element **42*a* in the form of a brush having flexible bristles which come to be applied against the upper face of the spacer plate when the brushing device is brought into operation. During the movements of the brushing device across the face of the plate in the course of machining, the case 42 remains in contact with the face of the plate through the medium of the flexible sealing element 42*a***.

The end of the suction pipe 29 opens onto the inside of the suction case 42 so as to draw off the dust or filings produced during the brushing of the spacer plate.

The brushes 36 have a shape of revolution about their axis of rotation which is defined by the axis of rotation of the shaft 35. Preferably the brushes 36 have a cylindrical shape and are made of synthetic fibers, such as nylon fibers, in which is incorporated an abrasive such as silicon carbide.

The driving of the brushing tools 33 is so arranged that the brushes 36 may be driven at a variable speed of rotation in either direction. Consequently, the circumferential brushing speed may be adjusted to an optimum value irrespective of the degree of wear, owing to the calculation made from the measurement effected by the sensor 41, this value usually being 10 and 20 m/s.

There will now be described an operation for deburring and chamfering a spacer plate, as the plate 1 shown in FIG. 1 or such the plate 2 shown in FIG. 2, by means of the process and device according to the invention.

To effect the deburring and the chamfering of a spacer plate after through openings have been formed therein, for example by broaching, the plate is taken up by hoisting and handling means such as an overhead crane and moved to the workshop 6 in the vicinity of the spacer plate positioning device 7. The platform 21 of the positioning device is put into its vertical position and the spacer plate is placed in position and fixed against the platform 21.

The orientation of the plate in the plane thereof is adjusted by turning the platform 21 about the axis 23 thereof at the end of the arm 22.

The spacer plate is placed in such position that the water way, i.e. a strip of the plate extending in the diametrical direction and devoid of openings, is in a perfectly vertical position.

The vertical diameter and the horizontal diameter of the spacer plate divide the latter into four quarters which define, for both sides of the plate, eight zones in which the deburring and chamfering of the edges of the through openings of the plate are effected in succession.

The plate is turned through a quarter of a turn between two deburring and chamfering operations relating to a quarter of one of the faces of the plate.

When the plate is in position on the platform of the positioning device, there is effected the location of the directions of the plate along which the brushes of the brushing unit must travel is determined and other parameters permitting the definition of the ideal conditions of the sweeping of the brushing unit across the plate are also determined.

In the case of a spacer plate such as the plate 1 shown in FIG. 1 comprising openings 2 of trilobate shape arranged in a network having triangular meshes, the deburring and the chamfering of the edges of the openings at the ends of the bearing surfaces 4 for the tubes must be effected along paths corresponding to the traces such as 5*a*, 5*b* and 5*c* of the planes containing the bearing surfaces of the openings 2.

The paths 5*a*, 5*b* and 5*c* are parallel to one another and disposed at a constant distance, substantially equal to the outside radius of the tubes 3, from a theoretical path 45*a*, 45*b* or 45*c* passing through the centers of the openings 2 of the rectilinear row in respect of which the machining of a group of planar bearing surfaces is effected.

The parameters defining the sweeping or scanning of the plate are determined from the theoretical paths 45*a*, 45*b* and 45*c* which are themselves defined by their inclination, for example with respect to the vertical dieter of the plate, and by the position of the axis of one of the openings 2.

A second parameter for determining the sweeping conditions is constituted by the fixed distance between the real paths 5*a*, 5*b* and 5*c* and the theoretical paths 45*a*, 45*b* and 45*c*.

Other parameters permit defining the full extent of the zone of the spacer plate provided with openings in which the finishing machining is effected (for example the radius of the zone occupied by the openings).

The parameters defining the sweeping of the spacer plate are introduced as input data in the microcomputer 14 and are printed on the printer 15. The microcomputer permits, during the finishing machining operations consisting of brushing of the plate, controlling the control unit 16 of the robot 8 so as to move the end of the arm of the robot and the brushing unit 20 perfectly along paths, such as paths 5*a*, 5*b*, 5*c*; the computer 14 also permits controlling the control cabinet 17 controlling the brushing unit 20 and its means for applying pressure against the plate.

The robot 8 places the brushing unit 20 in an initial position located in a peripheral part of the spacer plate 28 at the end of a path such as 5*a*, 5*b* or 5*c*.

Prior to this, the spacer plate 28 was pivoted to its working position in which it is at an angle of 30° to the vertical (FIG. 7).

After having started up the suction device 9 and the brushing unit, the brushing operation on a first quarter of a face of the plate is initiated from the control station and then continues in a fully automatic manner, the paths of direction 5*a*, then the paths of direction 5*b*, then the paths of direction 5*c* being described one after the other by the end part of the arm of the robot 8.

At the end of the path located by the limits of the zone of the plate to be machined, the robot moves the brushing unit in a direction perpendicular to the path so as to replace the brushing unit on a theoretical path in the vicinity of the real path just effected.

The brushing tool is then offset in the direction perpendicular to the theoretical path by a distance equal to the offset which was entered in the computer as a parameter of the process.

Optionally, a plurality of passes may be effected in each of the rectilinear paths before passing to the following path.

The number of passes per path may range from one to ten.

The brushing unit 20 disposed at the end of the arm of the robot is placed on the face of the plate in such manner that the axis of rotation of the brushes 36 which is parallel to the face of the plate is directed perfectly along the path along which the sweep is effected.

The direction of rotation of the brushes is so chosen that the brushes expel the metal cuttings or filings from the through openings of the spacer plate during the deburring and chamfering operation. The direction of rotation of the brushes is controlled, as a function of the direction of motion of the brushing unit, by the computer and the control program of the process.

The parameters determining the process which may be fixed at the start of the operation and optionally modified in the course of the operation, are the force with which the brushes bear against the face of the spacer plate, this force being usually between 60 and 120N, the circumferential speed, which is usually between 10 and 20 m/s, the linear speed of feed of the brushes along the paths, which is usually between 20 and 60 mm/s, the number of passes per path and the transverse offsets between the paths.

The deburring and chamfering operation is carried out on a quarter of a face of the plate in a completely automatic manner.

After the operation has been carried out on a quarter of a face of the plate, the robot stops and is moved to a retracted position so that the plate can be turned through a quarter of a turn.

The operation is pursued on a second quarter of the face of the plate.

When the complete brushing of a face of the plate has been achieved, the plate is turned round and the brushing parameters are possibly modified in order to take into account the fact that the operation on one of the faces of the plate is a deburring and chamfering operation and that the operation carried out on the other face of the plate is a surfacing and chamfering operation on the sharp edges of the openings.

The brushing conditions are perfectly defined and the brushing is carried out along paths perfectly parallel to the planes of the bearing surfaces for the tubes, and the deburring and the chamfering are effected in such manner that the chamfers of the edges of the bearing surfaces for the tubes are all identical and do not exhibit a portion of metal which projects from the face of the plate or from the inner surface of the opening and have a surface of great regularity.

The dust, filings or burrs removed from the plate during the brushing are drawn off by the suction device 9 so that these particles do not remain in the broaching zone and are not deposited on the plate or on the floor of the finishing workshop.

In the case of a spacer plate having openings of trifoliate shape arranged in a network having triangular meshes, as shown in FIG. 1, the brushing is always effected along a real path (such as 5*a*) located on the same side of the corresponding theoretical path (such as 45*a*). In starting with a theoretical path, there is therefore effected a brushing in a single real path disposed on one side of the theoretical path and offset a predetermined distance in a direction perpendicular to the paths.

In the case of a spacer plate such as the spacer plate 1' shown in FIG. 2 comprising openings of quadrifoliate shape arranged in accordance with a network having square meshes, the brushing of the plate is effected along two families of paths parallel to the paths 5'a and 5'b shown in FIG. 2.

For a given theoretical path (such as 45'a), brushings are effected in succession in two real paths 5'a and 5"a on each side of the theoretical path 45'a, the sweeping across the plate along the paths 5'a and 5"a being effected in different directions.

Likewise, for a given theoretical path 45'b, the sweeping is effected along two paths such as 5'b.

In every case, the sweeping across the plate is effected along paths parallel to the plane containing the bearing surfaces of the openings of the plate and in such manner as to effect in succession on a zone of the plate, for example a quarter of a face of the plate, the brushing of the edges of the bearing surfaces in a successive row corresponding to a rectilinear alignment of openings comprising a group of bearing surfaces disposed in the same plane perpendicular to the plate.

In every case, the process according to the invention permits achieving perfect elimination of the burrs without pushing back metal of the edges of the openings and perfectly regular chafers ensuring a continuous connection between the face of the plate and the inner surface of the opening.

Spacer plates are obtained in this way which have two perfectly smooth faces devoid of burrs and sharp edges. Any damage to the tubes of the bundle when they are inserted in the spacer plates is avoided.

The process according to the invention applies to spacer plates having a regular network of openings which have shapes different from those described and which are arranged in accordance with a network which is different from a network having triangular or square meshes. However, the bearing surfaces for the tubes in the openings of the plates must be located substantially in alignment in planes perpendicular to the faces of the plate.

The movement of the brushing unit on the faces of the plate may be achieved by means of a shifting device which is different from a robot having an articulated arm.

The brushing unit may also be arranged in a manner different from that described and include a single brush or, on the contrary, more than two brushes having aligned or parallel axes. The use of a larger number of brushes or of brushes having a greater axial length permits limiting the number of passes required in each of the paths and therefore limiting the total time required for brushing of the plate.

It will be understood that the device for positioning the plate may be arranged in a manner different from that described and that the plate brushing may be carried out on a plate having any inclination to the vertical.

The control and adjusting means of the process may be arranged in a manner different from that described.

The invention is applicable generally to any apertured plate whose openings are intended to receive and maintain in position elongate elements such as tubes.

What is claimed is:

1. A process for deburring and chamfering edges of through openings having axes extending through a plate for maintaining a bundle of tubes arranged in a regular network, each of said through openings comprising at least three bearing surfaces for a respective tube of said bundle, said bearing surfaces of all of said through openings of said plate being disposed in planes perpendicular to faces of said plate and parallel to said axes of said through openings, a group of said bearing surfaces of a rectilinear row of said openings of said network being disposed in each one of said planes in an aligned manner in a rectilinear direction, and said planes and said rectilinear rows of openings constituting at least a first group of parallel planes and of rows parallel to a first direction and a second group of parallel planes and of rows parallel to a second direction, said process comprising the steps of (a) moving at least one brush which is rotatable about an axis parallel to said plate so as to cause it to sweep across at least one face of said plate;

(b) deburring and chamfering said edges of said through openings in successive rectilinear rows;

(c) for each of said rectilinear rows, moving said at least one brush with said axis of rotation thereof parallel to the planes of said first group of planes, in a rectilinear path of a first group of paths parallel to said planes of said first group of planes; and (d) for each of said rectilinears rows of said second group of rows, moving said at least one brush with said axis of rotation thereof parallel to the planes of said second group of planes, in a rectilinear path of a second group of rectilinear paths parallel to said planes of said second group of planes.

2. The process according to claim 1, in the case of a plate in which said through openings are arranged in a triangular network and each comprise three bearing surfaces for a respective tube, said process comprising moving said at least one brush in succession along rectilinear paths constituting three groups of paths parallel to three directions which form angles of 60° with each other.

3. The process according to claim 1, in the case of a plate in which said through openings are arranged in a network having square meshes and each comprise four bearing surfaces for a respective tube spaced 90° apart from one another around the axis of the opening, said process comprising moving said at least one brush in succession along paths constituting two groups of paths, each path of a group of paths being parallel to one of two directions perpendicular to one another.

4. The process according to claim 1, comprising determining said rectilinear paths of movement of said at least one brush from theoretical paths passing through said axes of said through openings of the row in which said deburring is effected and from a predetermined offset of the path relative to said theoretical path in a direction perpendicular to said theoretical path.

5. The process according to claim 1, comprising adjusting to a predetermined value a force with which said at least one brush bears on said plate.

6. The process according to claim 1, comprising adjusting to predetermined values the circumferential speed of the brushing action of said at least one brush resulting from the speed of rotation of said at least one brush and the linear speed of the movement of said at least one brush along said rectilinear path.

7. The process according to claim 1, comprising determining wear of said at least one brush by measuring a position of said at least one brush in a direction perpendicular to said spacer plate.

8. The process according to claim 1, comprising adjusting the direction of rotation of said at least one brush as a function of the direction of movement of said at least one brush in said rectilinear path.

* * * * *